US008757512B2

(12) United States Patent
Schmieder et al.

(10) Patent No.: US 8,757,512 B2
(45) Date of Patent: Jun. 24, 2014

(54) INJECTOR FOR A FLUID

(75) Inventors: Dietmar Schmieder, Markgroeningen (DE); Thomas Sebastian, Erdmannhausen (DE)

(73) Assignee: Robert Bosch GmbH, Stuttgart (DE)

( * ) Notice: Subject to any disclaimer, the term of this patent is extended or adjusted under 35 U.S.C. 154(b) by 475 days.

(21) Appl. No.: 13/254,259

(22) PCT Filed: Nov. 12, 2010

(86) PCT No.: PCT/EP2010/067405

§ 371 (c)(1),
(2), (4) Date: Sep. 1, 2011

(87) PCT Pub. No.: WO2011/080002

PCT Pub. Date: Jul. 7, 2011

(65) Prior Publication Data

US 2011/0309164 A1 Dec. 22, 2011

(30) Foreign Application Priority Data

Dec. 29, 2009 (DE) ..... 10 2009 055 362

(51) Int. Cl.
*B05B 1/08* (2006.01)

(52) U.S. Cl.
USPC ..... 239/102.2; 239/453; 239/533.7; 239/584; 239/600; 239/DIG. 4; 123/498; 277/591; 277/598

(58) Field of Classification Search
USPC ..... 239/88, 102.2, 453, 533.2, 533.3, 239/533.7, 584, 600, DIG. 4; 123/498; 277/591, 598
See application file for complete search history.

(56) References Cited

U.S. PATENT DOCUMENTS

| | | | | |
|---|---|---|---|---|
| 6,663,015 | B2 * | 12/2003 | Yamada et al. | 239/102.2 |
| 6,745,956 | B1 * | 6/2004 | Bantle et al. | 277/591 |
| 7,832,656 | B2 * | 11/2010 | Matteucci et al. | 239/600 |
| 2002/0179062 | A1 | 12/2002 | Shen et al. | |
| 2003/0150939 | A1 | 8/2003 | Lorraine et al. | |

FOREIGN PATENT DOCUMENTS

| | | |
|---|---|---|
| DE | 10110678 | 10/2002 |
| DE | 10257895 | 6/2004 |
| DE | 10319599 | 11/2004 |
| DE | 102007028490 | 12/2008 |

OTHER PUBLICATIONS

International Search Report, PCT International Patent Application No. PCT/EP2010/067405, dated Feb. 24, 2011.

* cited by examiner

*Primary Examiner* — Steven J Ganey
(74) *Attorney, Agent, or Firm* — Kenyon & Kenyon LLP

(57) ABSTRACT

An injector for a fluid is provided, in particular for fuel, which has a valve housing, an intake nipple for the fluid disposed at one housing end, a nozzle body disposed at the other housing end, which has a valve seat surrounding a spray-discharge orifice, and a valve chamber disposed upstream therefrom, and a fluid-carrying pipe which extends in the valve housing and connects the valve chamber to the intake nipple. To achieve a connection of the fluid-carrying pipe to the valve chamber that is impervious to high operating pressures and is suitable in terms of production and convenient in terms of assembly, an axial blind hole which has an internal thread and is disposed at a radial offset to the housing axis of the valve housing, is formed in the nozzle body, and a fluid connection us established from the blind hole to the valve chamber. At its pipe end facing away from the intake nipple, the fluid-carrying pipe is screw-fitted in the blind hole and the threaded connection is sealed with respect to the blind hole.

13 Claims, 2 Drawing Sheets

INJECTOR FOR A FLUID

FIELD OF THE INVENTION

The present invention is based on an injector for a fluid, in particular for fuel.

BACKGROUND INFORMATION

In a conventional fuel injector for internal combustion engines (described, for example, in German Patent Application No. DE 102 57 895 A1), the fluid-carrying pipe is integrated into the valve housing and runs at a parallel offset with respect to the housing axis, the pipe connecting the intake nipple to the valve chamber upstream from the valve seat in the nozzle body remote from the intake nipple. The valve housing encloses a cavity which has a circular-cylindrical cross-section, inside which cavity a piezoelectric or magnetorestrictive actuator is disposed for actuating the valve. The housing wall, which has a circular ring-shaped cross-section, is radially built up on one side throughout its length and provided with an axial bore in the built-up region, in which the pipe is guided. At the lower end, the pipe is bent at approximately 90°, inserted in a radial opening in the nozzle body discharging into the valve chamber and welded or soldered to the nozzle body. At the end facing away from the nozzle body, the pipe is affixed to the intake nipple and permanently connected to the intake nipple.

SUMMARY

The injector according to the present invention may have the advantage that as a result of the threaded connection between the fluid-carrying pipe and the nozzle body containing the valve chamber, and as a result of the at least one sealing element integrated in the threaded connection, a connection exists between the nozzle body and the pipe, which is able to withstand high stressing and which also withstands the increasingly required high fuel pressures in the fuel injector while providing reliable tightness.

According to one advantageous development of the present invention, the fluid connection between the blind hole having the internal thread and the valve chamber is formed by a transverse bore extending in the nozzle body, which bore ends beneath the internal thread in the base of the blind hole. With the aid of such a transverse bore which preferably is radially introduced in the nozzle body, the connection between the blind hole eccentrically disposed in the nozzle body, and the centrally disposed valve chamber is able to be realized very advantageously in terms of production engineering.

According to one advantageous development of the present invention, the at least one sealing element is a sealing ring made of polytetrafluorethylene (PTFE) and lies in an annular groove inside the external thread. This sealing ring is widened during the installation, slipped over the external thread, and snaps into place in the annular groove. Then, the external thread is screwed into the internal thread of the nozzle body, and the PTFE sealing ring reliably seals the threaded connection even at high injection pressures.

According to one advantageous specific embodiment of the present invention, a leakage bore leading to the outside is introduced in the nozzle body, which ends in the blind hole above the sealing element in the region of the internal thread. Situated above the leakage bore, within the threaded connection of internal and external thread, is a second sealing element, which, for example, may likewise be developed as PTFE sealing ring. Leakages possibly occurring via the first sealing element are able to routed to the outside, e.g., into the crank housing of the internal combustion engine, with the aid of the leakage bore. Since a pressure of approximately 5 bar usually prevails inside the crank housing, the second sealing element ensures that no leakage enters the interior of the valve housing, inside which the not fuel-resistant, actuator for actuating the fuel injector is situated. In addition, a tightness check of the first sealing element is able to be performed via the leakage bore.

According to one advantageous specific development of the present invention, the external thread is formed on a hollow-cylindrical connecting piece separate from the pipe, which is affixed to the pipe end, preferably partly inserted in this pipe, and permanently connected to the pipe. The connection is made by soldering or welding. The pipe is guided in a feed-through opening coaxial to the blind hole in the nozzle body, which opening is formed in a connecting piece covering the valve housing at its housing end facing away from the nozzle body. The axial length of the pipe is dimensioned such that it axially projects from the connecting piece when the connecting piece is completely screwed into the interior thread in the blind hole. The intake nipple is placed on the projecting pipe end and permanently connected to the pipe, preferably by press-fitting and welding. In this way a premanufacturable unit made up of intake nipple, pipe and connecting piece is achieved in an advantageous manner in terms of production technology, which is advantageously able to be installed in an uncomplicated fashion by inserting it into the valve housing, through the through-hole in the connecting piece, and screwing it into the blind hole in the nozzle body. The sealing element previously inserted into the external thread of the connecting piece automatically produces reliable sealing of the threaded connection between connecting piece and nozzle body.

According to one advantageous specific development of the present invention, the connecting piece carries an external thread, and an internal thread for screw-fitting the connecting piece is made available in the through-hole in the connecting piece. The screw connection of the intake nipple in the connecting piece increases the robustness of the injector with respect to rough operating modes. The interface between connecting piece and pipe or intake nipple is sealed both when the pipe is only guided through the connecting piece and when the intake nipple is screwed in, the sealing preferably being realized by a welding or soldered seam on the pipe or intake nipple extending peripherally on the surface of the connecting piece. Such additional sealing may be omitted if a plastic element, which partially surrounds the intake nipple, is injection-molded onto the connecting piece according to one advantageous specific embodiment of the invention.

BRIEF DESCRIPTION OF THE DRAWINGS

The present invention is explained in greater detail below on the basis of exemplary embodiments shown in the figures.

DETAILED DESCRIPTION OF EXAMPLE EMBODIMENTS

Figure 1:
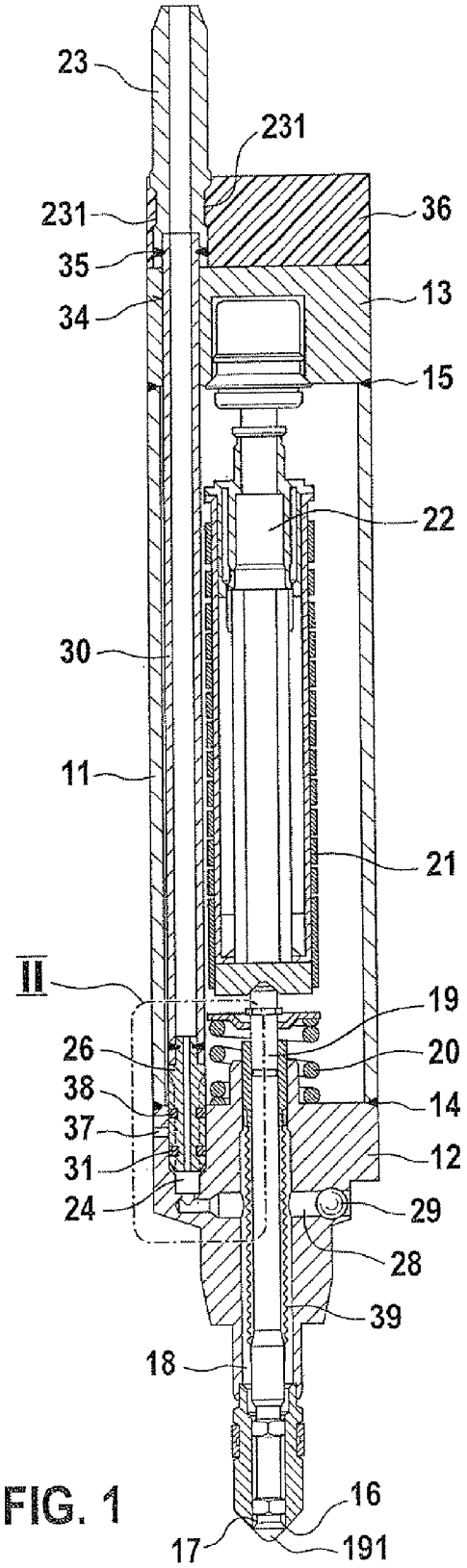
FIG. 1 shows a longitudinal section of an injector for a fluid.

The injector, shown in FIG. 1 in longitudinal section, for a fluid such as fuel in a fuel supply system for internal combustion engines, has a sleeve-type valve housing 11, for example, whose one housing end is sealed by a nozzle body 12, and whose other housing end is covered by a connecting piece 13. Nozzle body 12 and connecting piece 13 are permanently connected to valve housing 11, e.g., by a circumferential welding seam 14, 15. A spray-discharge orifice 17 enclosed by a valve seat 16 is situated at the free end of nozzle body 12. A valve chamber 18 is disposed upstream from valve seat 16. Projecting through valve chamber 18 is valve needle 19, which is guided inside nozzle body 12 in displaceable manner, the valve needle, via a closing head 191, being pressed onto valve seat 16 by a valve closure spring 20 braced on nozzle body 12 and on valve needle 19, while spray-discharge orifice 17 is closed. A piezoelectric actuator 21 is provided to actuate valve needle 19, which open outwardly, against the restoring force of valve closure spring 20, the actuator being received in valve housing 11, in series with a hydraulic coupler 22, and clamped between valve needle 19 and connecting piece 13 in frictionally locked manner in the axial direction. Structure and function of actuator 21 and coupler 22 are described in German Patent Application Nos. DE 10 319 599 A1 or DE 10 2007 028 490 A1, for example.

Figure 2:
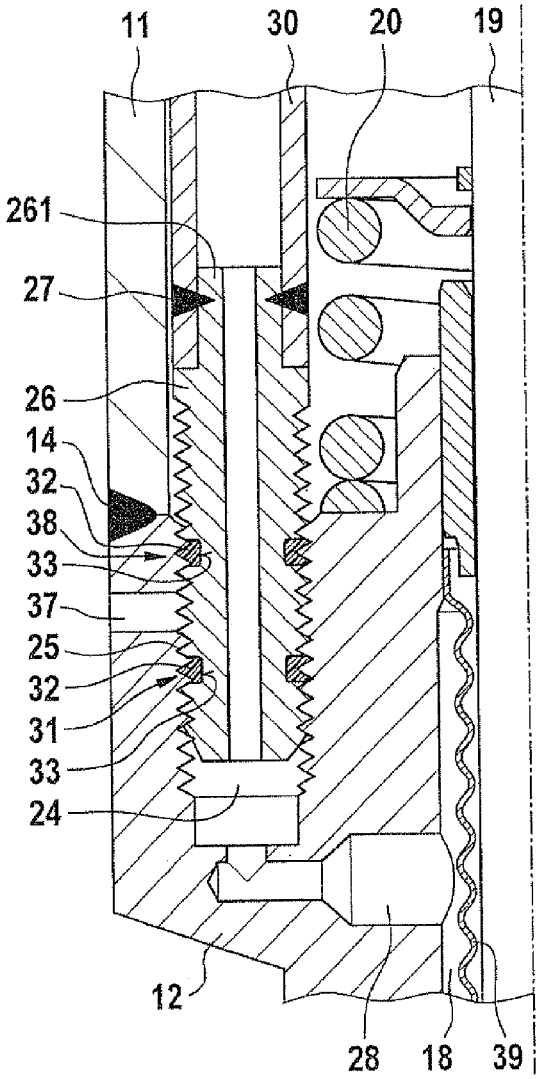
FIG. 2 shows an enlarged view of detail 11 in FIG. 1.

At the housing end of valve housing 11 covered by connecting piece 13, an intake nipple 23 is disposed for slipping over a fuel supply line. A pipe 30 guided through valve housing 11 establishes a fluid connection between input nipple 23 and valve chamber 18. For this purpose, an axial blind hole 24, which is disposed at a radial offset relative to the housing axis of valve housing 11 and has an internal thread, is provided inside nozzle body 12, and pipe 30 is screw-fitted in the internal thread by means of an external thread at its pipe end facing away from intake nipple 23. The threaded connection of internal and external thread is denoted by 25 in FIG. 2. Preferably, the external thread is not cut directly on the pipe end of thin-walled pipe 30, but on a thick-walled, hollow-cylindrical connecting piece 26, which is inserted into the pipe end via a nipple 261 having a reduced diameter and welded or soldered thereto, as illustrated in FIG. 2 by sketched welding seam 27. Starting from blind hole 24, a fluid connection to valve chamber 18 is established beneath threaded connection 25. This fluid connection is realized by a transverse bore 28, which ends in blind hole 24, in this case, the base of the blind hole. As illustrated in FIG. 1, transverse bore 28 is radially introduced in nozzle body 12 and sealed in pressure-tight manner at the end remote from blind hole 24, by means of a press-fitted ball 29. At least one sealing element 31, which reliably prevents fluid leakage from blind hole 24 into the interior of valve housing 11 in which non-fuel-resistant actuator 21 is situated, is disposed in threaded connection 25.

As can be gathered from FIG. 2, in particular, sealing element 31 is a sealing ring 32 made of polytetrafluorethylene (PTFE), which lies inside an annular groove 33 within the external thread cut into connecting piece 26. For the assembly, sealing ring 32 is widened with the aid of a conical spreader punch, which covers the external thread up to annular groove 33, and snapped into place in annular groove 33. When the external thread is screwed into the internal thread of nozzle body 12, sealing ring 32 seals the thread turns in a reliable manner even at high pressures. Instead of implementing sealing element 31 as such a sealing ring 32, it is also possible to coat the internal or external thread of threaded connection 25 with a sealing layer made of an elastomer material, e.g., Teflon, which likewise establishes reliable sealing between the threads during the screw-fit operation.

Fluid-carrying pipe 30 extending through the interior of valve housing 11 between housing wall and actuator 21 is guided through a through-hole 34 introduced in connecting piece 13 coaxially with respect to blind hole 24, the length of pipe 30 being dimensioned such that it axially projects from connecting piece 13 when connecting piece 26 is fully screwed into the internal thread in blind hole 24. Intake nipple 23 is mounted on the projecting pipe end, press-fit with the pipe and welded (welding seam 35 in FIG. 1).

During assembly, first pipe 30, connecting piece 26, and intake nipple 23 are joined to form a subassembly. This subassembly is guided through through-hole 34 in connecting piece 13 and screw-fitted with connecting piece 26 in blind hole 24 of nozzle body 12. Intake nipple 23 is provided with two diametral flat regions 231 for the engagement with a turning tool. Once connecting piece 26 has been fully screw-fitted in blind hole 24, a plastic element 36 is injection-molded onto connecting piece 13, which hermetically encloses intake nipple 23 in its lower region facing connecting piece 13. For one, this seals through-hole 34 in connecting piece 13 in fluid-tight manner and for another, it stabilizes intake nipple 23. If injection-molded plastic element 36 is omitted, then the passage of pipe 30 through connecting piece 13 must be sealed, which preferably is done by a welding seam around pipe 30 on the surface of connecting piece 13.

In the illustrated exemplary embodiment, a leakage bore 37, which discharges in the region of threaded connection 25 in blind hole 24, is additionally introduced in nozzle body 12. Above leakage bore 37, i.e., on the side of the outlet of leakage bore 37 in blind hole 24 facing away from sealing element 31, a second sealing element 38 is situated within threaded connection 25. The design of second sealing element 38 is identical to that of first sealing element 31, that is to say, it also has a sealing ring made of PTFE, which lies inside an annular groove 33 in connecting piece 26. Here, too, it is possible to coat one of the threads of threaded connection 25 with a sealing layer. Second sealing element 38 seals leakage bore 37 from the interior of valve housing 18. Leakage bore 37 has the task of discharging possibly occurring leakages via first sealing element 31, e.g., into the crank housing of the internal combustion engine. Furthermore, leakage bore 38 allows a leakage test of first sealing element 31.

To seal the connection from the interior of valve housing 11 to valve chamber 18 provided via valve needle 19, expansion bellows 39 are slipped over valve needle 19, the one end of the bellows being mounted on valve needle 19 in fluid-tight manner, and the other end of the bellows, on nozzle body 12.

Figure 3:
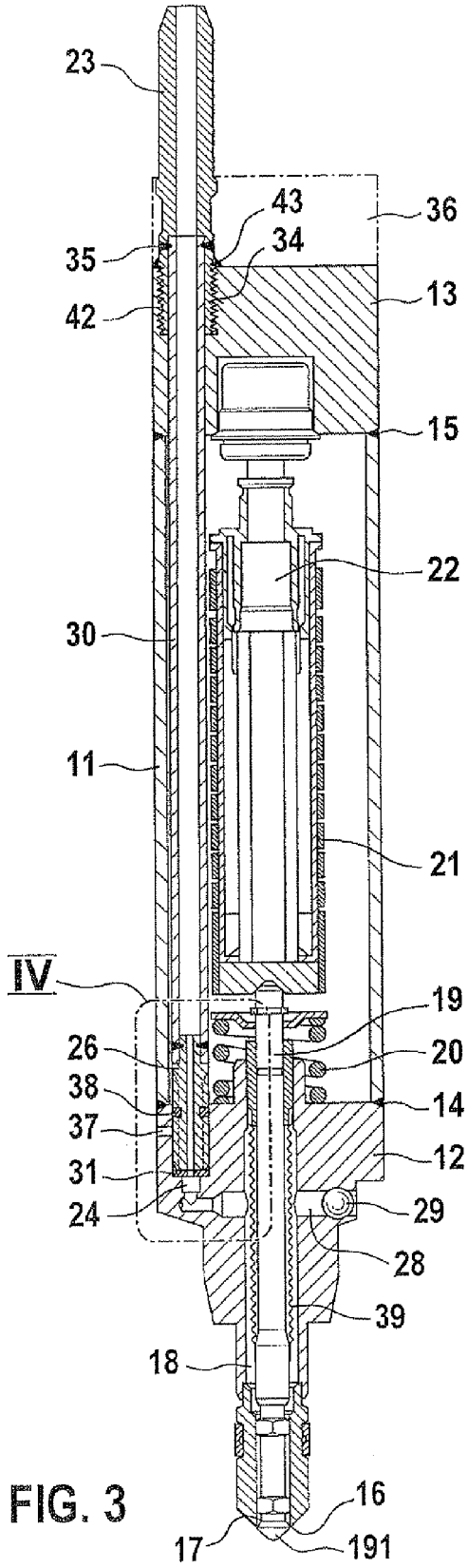
FIG. 3 shows a view, identical to FIG. 1, of a modified injector.
Figure 4:
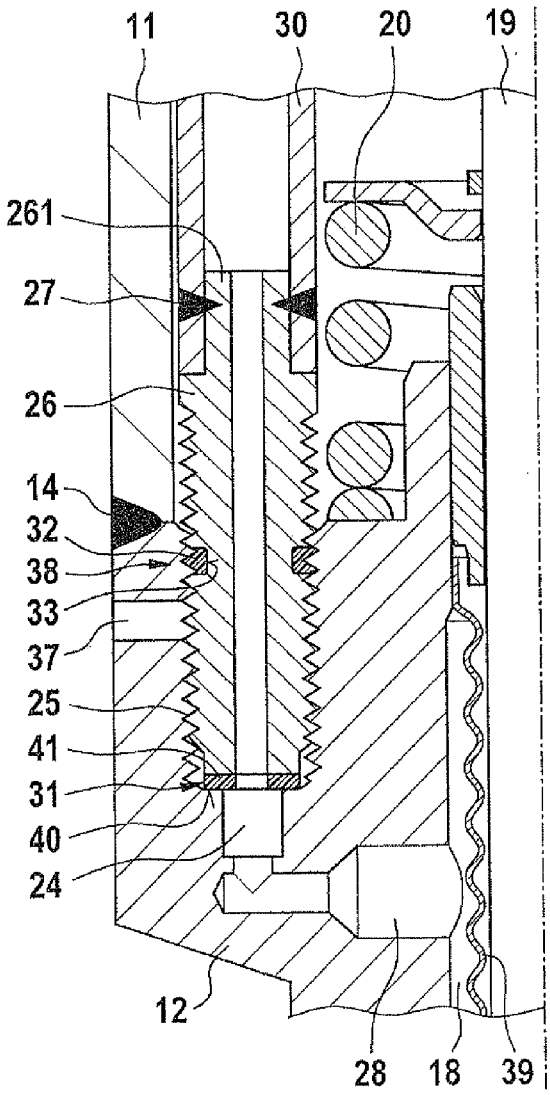
FIG. 4 shows an enlarged view of detail IV in FIG. 3.

The injector shown in FIG. 3 in longitudinal section is modified in comparison with the previously described injector, insofar as first sealing element 31 is implemented as axial rather than as radial seal. For this purpose, the base of the blind hole has a smaller diameter in comparison with the blind hole diameter, so that a ring shoulder 40 (FIG. 4), which is situated upstream from the outlet of transverse bore 28, exists at the transition from blind hole 24 to the blind hole base. An annular sealing disk 41 made of PTFE is situated on this ring shoulder 40. During the screw-fitting of the subassembly made up of pipe 30, connecting piece 26, and intake nipple 23, the end face of the subassembly, i.e., the annular end face of connecting piece 26 in this case, presses on sealing disk 41.

A further modification of the injector consists of the fact that intake nipple 23 carries an external thread, which is screw-fitted with an internal thread cut into through-hole 34 in connecting piece 13. The threaded connection between intake nipple 23 and connecting piece 13 is denoted by 42 in FIG. 3. To guide pipe 30 through connecting piece 13 in fluid-tight manner, intake nipple 23 is connected to connecting piece 13 via a circumferential welding seam 43. Welding seam 43 may be omitted if—as is the case with the injector in FIG. 1—a plastic element 36, which partly encloses intake nipple 23, is injection-molded on connecting body 13, as sketched in FIG. 3 by a dash-dotted line.

In all other respects, the injector according to FIG. 3 corresponds to the injector shown in FIG. 1, so that identical components have been provided with matching reference numerals.

What is claimed is:

1. An injector for a fluid, comprising:

a valve housing;

an intake nipple for the fluid, the intake nipple being disposed on a housing end of the valve housing;

a nozzle body disposed on another housing end, the nozzle body having a valve seat surrounding a spray-discharge orifice;

a valve chamber upstream from the valve seat; and a fluid-carrying pipe which runs inside the valve housing and connects the valve chamber to the intake nipple;

wherein an axial blind hole having an internal thread is formed in the nozzle body at a radial offset to a housing axis of the valve housing, and a fluid connection is established from the blind hole to the valve chamber, the pipe is screw-fitted in the internal thread at its pipe end on a side of the valve chamber, using an external thread, and a threaded connection of internal and external thread is sealed with respect to the blind hole using at least one sealing element.

2. The injector as recited in claim 1, wherein the fluid connection between blind hole and valve chamber is formed by a transverse bore, which runs inside the nozzle body and discharges beneath an interior thread in a base of the blind hole.

3. The injector as recited in claim 2, wherein a leakage bore leading to outside discharges in the blind hole above the at least one sealing element in a region of the internal thread, and a second sealing element is disposed above the leakage bore in a region of the threaded connection.

4. The injector as recited in claim 3, wherein the second sealing element is a sealing ring made of PTFE which lies inside an annular groove within the external thread.

5. The injector as recited in claim 1, wherein the at least one sealing element is a sealing ring made of PTFE which lies inside an annular groove inside the external thread.

6. The injector as recited in claim 5, wherein the at least one sealing element is an annular sealing disk of PTFE which is press-fitted on a ring shoulder in the blind hole, upstream from a mouth of the fluid connection, in axially friction-locked manner.

7. The injector as recited in claim 1, wherein the at least one sealing element is formed by a sealing layer made of an elastomer, with which one thread of the threaded connection is coated.

8. The injector as recited in claim 7, wherein the elastomer is Teflon.

9. The injector as recited in claim 1, wherein the external thread is disposed on a hollow-cylindrical connecting piece which is separated from the pipe and placed on the pipe end, partially inserted therein, and permanently connected to the pipe.

10. The injector as recited in claim 9, wherein the pipe is fed through a through-hole, coaxial to the blind hole in the nozzle body, in a connecting piece which covers the valve housing at its housing end facing away from the nozzle body, and its axial length is dimensioned such that it axially projects from the connecting piece when the connecting piece is fully screwed into the blind hole, and the intake nipple is placed on the projecting pipe end and permanently connected thereto by press-fitting and welding.

11. The injector as recited in claim 10, wherein the intake nipple (23) is provided with an external thread, which is adapted to be screwed into an internal thread formed in the through-hole.

12. The injector as recited in claim 10, wherein the intake nipple is partially enclosed by a plastic element injection-molded onto the connecting piece.

13. The injector as recited in claim 10, wherein the pipe is sealed with respect to the through-hole in the connecting piece by a welding or solder seam placed around the pipe or the connecting piece on a surface of the connecting piece.

* * * * *